US006050839A

United States Patent [19]

Seminara et al.

[11] Patent Number: 6,050,839

[45] Date of Patent: Apr. 18, 2000

[54] SEALED CONNECTOR

[75] Inventors: Phil Seminara, Detroit; Roger W. Wayt, Dearborn, both of Mich.

[73] Assignee: Lear Automotive Dearborn, Inc., Southfield, Mich.

[21] Appl. No.: 08/942,229

[22] Filed: Oct. 1, 1997

[51] Int. Cl.[7] ..... H01R 13/629

[52] U.S. Cl. ..... 439/364; 174/72 A; 439/559

[58] Field of Search ..... 439/559, 364, 439/34; 174/87

[56] References Cited

U.S. PATENT DOCUMENTS

| | | | |
|---|---|---|---|
| 4,862,011 | 8/1989 | Wright | 439/34 |
| 5,139,431 | 8/1992 | Saitoh et al. | 439/559 |
| 5,454,737 | 10/1995 | Saba | 439/655 |
| 5,460,530 | 10/1995 | Toba et al. | 439/34 |
| 5,586,909 | 12/1996 | Saba | 439/559 |
| 5,642,999 | 7/1997 | Kidd et al. | 439/364 |

*Primary Examiner*—Neil Abrams
*Assistant Examiner*—Eugene G. Byrd
*Attorney, Agent, or Firm*—MacMillan, Sobanski & Todd, LLC

[57] ABSTRACT

An electrical connecting system for electrically connecting a vehicle door to a vehicle body includes a wiring harness with first and second electrical connectors. The wiring harness extends between the vehicle door and body and is surrounded by a flexible covering which protects the wiring harness from outside contaminants. A fastener holds the first and second electrical connectors securely together and partially extends through the flexible covering such that the fastener is easily accessible. A tight seal is provided between the fastener and the flexible covering and between the flexible covering and the vehicle door and body.

5 Claims, 2 Drawing Sheets

SEALED CONNECTOR

BACKGROUND OF THE INVENTION

This invention relates to a unique electrical connecting system for a vehicle door assembly utilizing an easily accessible fastener for holding two mating electrical connectors together while sealing the connectors from outside contaminants.

Many vehicle doors are built off line in a separate assembly process to increase vehicle assembly efficiency. The completed door assemblies are then later assembled onto the vehicle. Because the door assembly is built separately from the vehicle body, it is necessary to provide a simple and efficient way for electrically connecting the door to the vehicle body to communicate to and from electrical components in the door. Typically, a wiring harness extends from the vehicle body and terminates at a first electrical connector. This first electrical connector is inserted into a mating electrical connector in the door assembly, thus providing electrical communication to the door components. These electrical connectors are usually large in size and require an additional form of connection to hold the pieces securely together. Often, they are bolted together. Also, it is important to seal these electrical connectors from outside contaminants.

The prior art has used various types of flexible coverings to seal electrical door connectors from outside contaminants. When fasteners or other mechanical assists are used to securely hold mating electrical connectors together it is difficult to seal the electrical connectors with a flexible covering while still providing convenient access for assembly and maintenance purposes. When used with a bolted together connector, these systems required removal of the seal before allowing access to the bolt.

Therefore, it is desirable to provide some form of mechanical assist, such as a fastener, for holding the two connectors securely together which is easily accessed during assembly of the door to the body, while still providing a sealed environment for the wiring harness and electrical connectors.

SUMMARY OF THE INVENTION

The present invention discloses an electrical connecting system for electrically connecting a vehicle door to a vehicle body. A wiring harness has a first electrical connector and extends between the vehicle door and body. The wiring harness is surrounded by a flexible covering which protects the wiring harness from outside contaminants. The first connector is attached to a second connector at the vehicle door.

A fastener holds the first and second electrical connectors securely together and partially extends through the flexible covering such that the fastener is easily accessible and does not require the flexible covering to be removed for access to or replacement of the fastener. A tight seal is provided between the fastener and the flexible covering and between the flexible covering and the vehicle door and body.

In the preferred embodiment, the electrical connecting system communicates between a vehicle door and a vehicle body. A flexible covering extends between openings of in a vehicle door and vehicle body. A first wiring harness, having a first electrical connector, extends between these openings and is generally enclosed by the flexible covering. A second wiring harness, having a second electrical connector for connecting to the first electrical connector, is adapted to be mounted in the vehicle door. At least one fastener fastens the electrical connectors and the flexible covering, and is removable from outside the flexible covering.

The subject invention offers several advantages over prior art systems because it provides an easily accessible fastener for holding the first and second electrical connectors securely together without exposing the electrical wiring harness or electrical connectors to outside contaminants.

These and other features of the present invention can be best understood from the following specification and drawings, of which the following is a brief description.

DETAILED DESCRIPTION OF A PREFERRED EMBODIMENT

Figure 1:
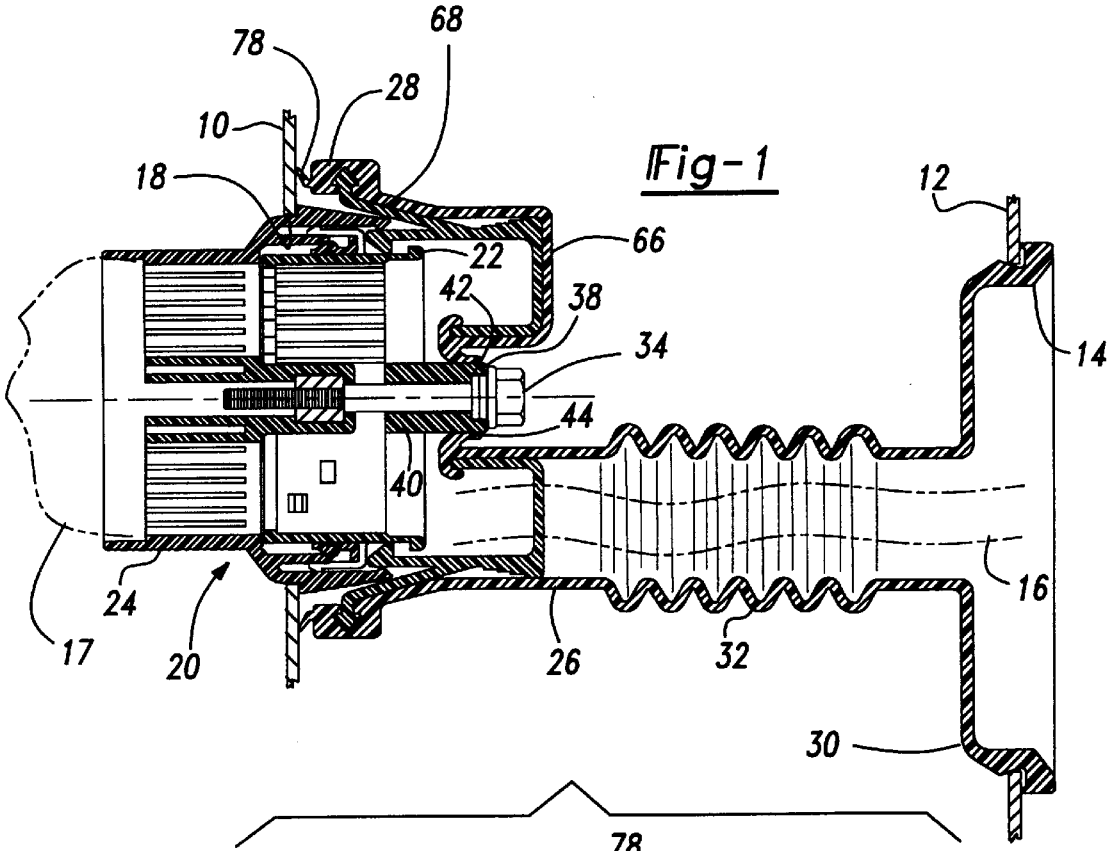
FIG. 1 is a cross-sectional view of the sealed connectors.

FIG. 1 shows an electrical connecting system extending between a sheet metal portion of a vehicle door 10 and a vehicle body 12. The vehicle body 12 pivotally supports the vehicle door 10 and includes an opening 14 through which a first wiring harness 16 extends. The composition and design of the wiring harness 16 is well known in the art. The first wiring harness 16 communicates power and control signals to and from the body 12 and door 10.

During the vehicle assembly process where the doors 10 are built off line in a separate assembly process, the first wiring harness 16 must be connected to a second wiring harness 17 associated with the vehicle door 10. Thus, the vehicle door 10 also has an opening 18 through which the second wiring harness 17 extends to communicate to the various door components. The wiring harnesses 16, 17 are interconnected by an electrical connector assembly generally shown at 20. The electrical connector assembly 20 has first 22 and second 24 electrical connectors which are mated together. The first wiring harness 16 terminates at the first electrical connector 22 and the second wiring harness 17 terminates at the second electrical connector 24. The disclosed first electrical connector 22 receives the second electrical connector 24, completing the electrical connection of the door 10 to the vehicle body 12.

A flexible tube-like covering 26 extends between the opening 14 in the vehicle body 12 and the opening 18 in the vehicle door 10. The wiring harness 16 which also extends between these openings 14, 18 is generally enclosed by the flexible covering 26. The flexible covering 26 protects the wiring harness 16 and the electrical connectors 22, 24 from outside contaminants by providing a sealed environment inside of the flexible covering 26. The flexible covering 26 has a first end 28 for engaging the vehicle door 10 and a second end 30 for engaging the vehicle body 12. The first end 28 surrounds and seals the opening 18 of the door 10 and the second end 30 surrounds and seals the opening 14 of the body 12. Typically, the flexible covering 26 is pulled through opening 14 such that end 30 is secured to body 12 before end 28 is secured to the door 10.

In the preferred embodiment, the flexible covering 26 is a rubber boot with the first 28 and second 30 ends interconnected by an expandable central accordion portion 32. However, any type of covering made from an appropriate flexible material can be used. An important feature is that the covering must be able to expand and retract as the vehicle door 10 is opened and closed.

A secondary mechanical assist or fastener 34 is used to securely hold the two connectors 22, 24 together. Initially, the first connector 22 is snapped into a pre-lock position in the second connector 24, as shown in FIG. 3. This assembly will be explained with reference to FIGS. 2 and 3 below.

A tight seal is provided between the flexible covering 26 and the fastener 34. In the preferred embodiment, a protective sleeve 38 is press fit into the opening 36 of the flexible covering 26 such that a first portion 40 of the sleeve extends into the interior area enclosed by the flexible covering 26 while a second portion 42 of the sleeve 38 remains outside of the area enclosed by the flexible covering 26. The fastener 34 is then inserted into the sleeve 38 such that the sleeve 38 tightly surrounds the fastener 34 resulting in a seal between the fastener 34 and the sleeve 38 and a seal between the sleeve 38 and the flexible covering 26. The opening 36 of the flexible covering 26 is surrounded by a raised lip 44. When the fastener 34 is assembled into the flexible covering 26, the lip 44 forms a tight seal against the sleeve 38.

While a threaded fastener 34 is used to securely join the first 22 and 24 second electrical connectors to each other in the preferred embodiment, it should be understood that any type of mechanical assist known in the art could be used. Also, while only one fastener is shown in the preferred embodiment, it should be understood that more than one fastener or a combination of different types of fasteners could be used to join the connectors.

Figure 2:
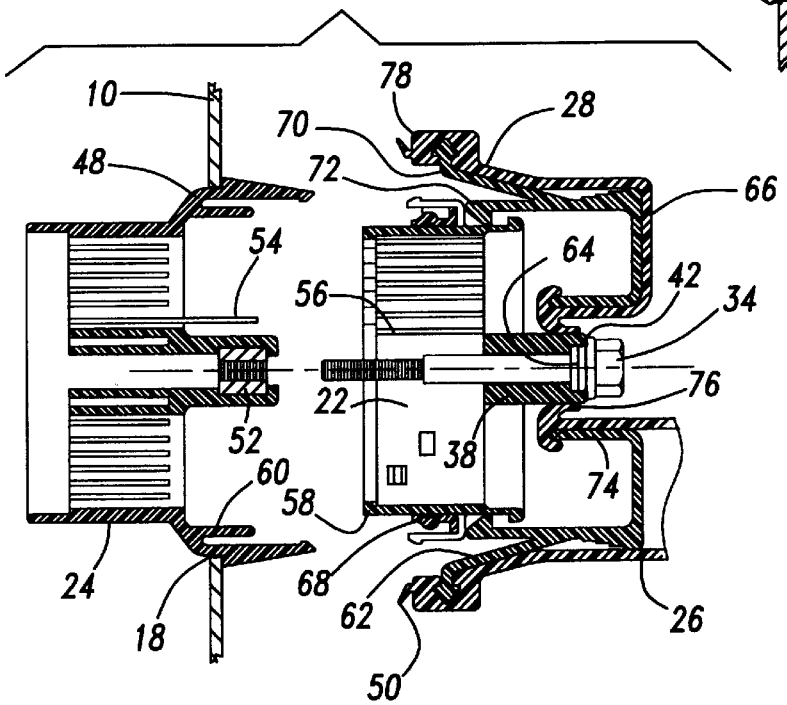
FIG. 2 is a magnified and partially exploded view of the connectors shown in FIG. 1.
Figure 3:
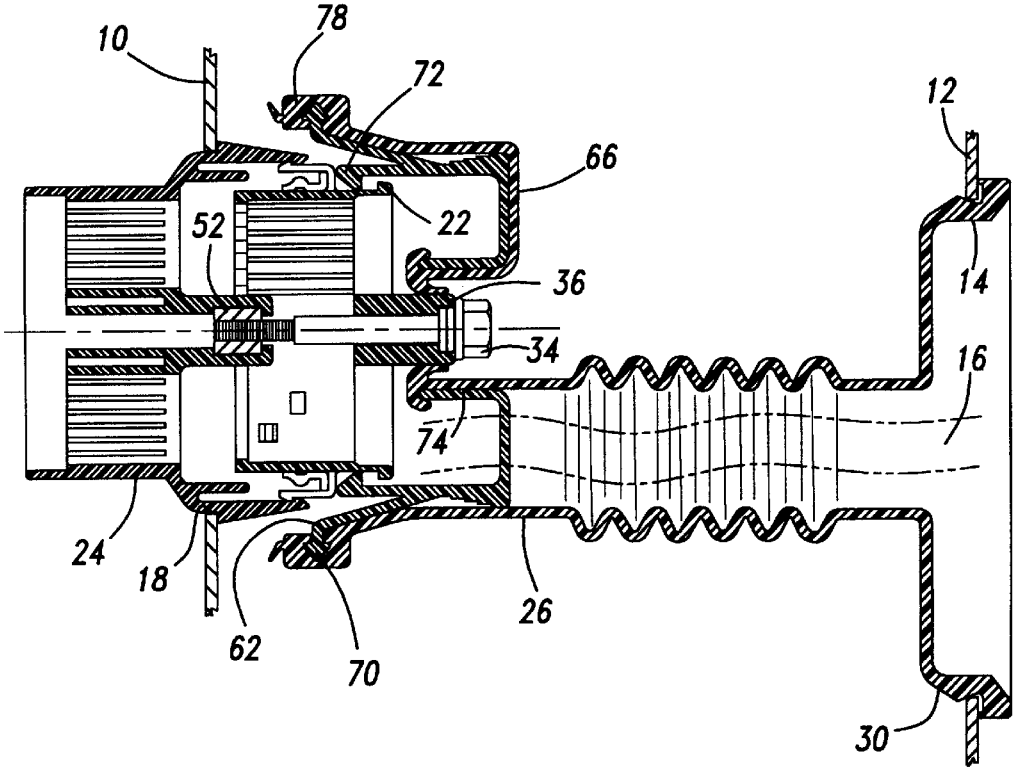
FIG. 3 shows an intermediate assembly step.

As shown in FIG. 2, the second connector 24 snaps into the opening 18 in the door 10 and is securely fixed to the sheet metal of the door 10 by a connector lock 48. A seal bead 50 surrounds the opening 18 in the door 10 and will seal the sheet metal of the door 10 to the flexible covering 26 and insures no outside contaminants can enter the area enclosed by the flexible covering 26. A threaded insert 52, supported by the second connector 24, is used to securely hold the fastener 34 in place. Although, a threaded insert 52 is shown it should be understood that other holding components, such as nuts inserted in one of the connectors, could be used instead.

In the preferred embodiment, an o-ring seal 64 is seated in sleeve 38 associated with the first connector 22 and surrounds the fastener 34. This o-ring seal 64 provides a tight seal between the connector 22 and the fastener 34. Also in the preferred embodiment, a grommet 66 is attached to or formed as part of the first end 28 of the flexible covering 26. The grommet 66 at one end 76 surrounds the sleeve 38 and provides a tight seal between the flexible covering 26 and the sleeve 38. At its other end 78 the grommet 66 engages the door 10 to provide a seal between the door 10 and the flexible covering 26, thus, preventing contaminants from affecting the connectors 22, 24. A peripheral seal 68 is provided between the first 22 and second 24 connectors.

A wire dress cover 62 extends between the first connector 22 and flexible cover 26. The wire dress cover 62 includes a first leg 70 for attachment to the grommet 66 and a second leg 72 for engagement with the first connector 22. A third portion or third leg 74 of the wire dress cover 62 attaches to the end 76 of the grommet 66 near the fastener 34. The dress cover 62 provides a quick-disconnect capability for removing the dress 62 and flexible 26 covers for service to the connectors 22, 24.

The electrical connectors 22, 24 are well known in the art and include pins 54 (only one shown) in one connector and holes 56 in the other connector. Obviously, either connector 22 or 24 could have the pins 54 or holes 56. The pins 54 are inserted into the holes 56 resulting in an electrical connection between the wiring harnesses 16, 17. The first 22 and second 24 electrical connectors have first 58 and second 60 surfaces, respectively. When the first 22 and second 24 connectors are mated together, the first surface 58 slidably engages the second surface 60.

As shown in FIG. 3, the first connector 22 is snapped into a pre-lock position in the second connector 24. Next, the fastener 34 is driven into place and first connector 22 is drawn into the second connector 24 and locked into place. This also pulls one end 78 of the grommet 66 against the door 10 to provide a tight seal between the grommet 66 and the door 10, as shown in FIG. 1. This allows for hands off assembly of the connectors 22, 24 when torque is applied to the fastener 34. Thus, at least one fastener 34, such as a bolt, is used to fasten the first 22 and 24 second electrical connectors to each other. The fastener 34 also fastens the connectors 22, 24 to the flexible covering 26. The flexible covering 26 includes an opening 36, through which the fastener 34 partially extends. This provides easy access to the fastener 34 without having to remove the flexible covering 26. By inserting the fastener 34 through the opening 36 in the flexible covering 26, the process for assembling the door 10 onto the body 12 is faster and more efficient.

A method of electrically connecting the vehicle door 10 to the vehicle body 12 includes the following steps. The vehicle body 12 is provided with the opening 14 for the first wiring harness 16 and the vehicle door 10 is provided with the opening 18 for the second wiring harness 17. The first wiring harness 16 terminates at the first electrical connector 22 and the second wiring harness 17 terminates at the second electrical connector 24. The flexible covering 26 is attached and sealed to the body 12 and generally encloses the first wiring harness 16. The door 10 with wiring harness 17 and connector 24 is mounted to the vehicle body 12. The first 22 electrical connector is then place in its prelock condition with respect to the second 24 electrical connector, shown in FIG. 2. The flexible covering 26 is extended and sealed to the door 10 completing the enclosure of the connectors 22, 24 and the wiring harnesses 16, 17. A fastener 34 fastens the first 22 and second 24 electrical connectors to the flexible covering 26 and is provided with a tight seal between the fastener 34 and the flexible covering 26 to keep out contaminants. As the fastener 34 is driven into place, the first connector 22 is drawn into the second connector and locked into place, providing the communication between the first 16 and second 17 wiring harnesses.

Additional steps include providing the opening 36 in the flexible covering 26 for receiving the sleeve 38 which surrounds the fastener 34 and provides a tight seal between the fastener 34 and the flexible covering 26. Also, the second connector 24 includes a threaded insert 52 for threadably engaging and securely holding the fastener 34 in place.

Although a preferred embodiment of this invention has been disclosed, it should be understood that other applications would come within the scope of this invention. For that reason, the following claims should be studied to determine the true scope and content of this invention.

We claim:

1. An electrical connecting system for extending between a vehicle door and a vehicle body comprising:

a first electrical connector having a first end, a second end opposite said first end, an outer periphery extending between said first and second ends, and a lip extending from said outer periphery, said first end being adapted for electrical connection to a wiring harness and said second end being adapted for electrical connection to a second electrical connector;

a grommet made from a flexible material and receiving said first end of said first electrical connector; said grommet having one end sealing against said first electrical connector and another end adapted for sealingly engaging a surface of a vehicle; and a wire dress cover disposed in and attached to said grommet, said wire dress cover having a leg releasably attached to said outer periphery of said first electrical connector whereby when said leg of said wire dress cover is flexed, said wire dress cover becomes detached from said first electrical connector and said wire dress cover and said grommet can be separated from said first electrical connector as an assembly to expose said first end of said first electrical connector.

2. The electrical connecting system according to claim 1 wherein said leg is a second leg, said wire dress cover having a first leg attached to said one end of said grommet and a third leg attached to said another end of said grommet.

3. The electrical connecting system according to claim 1 including a second electrical connector for removably receiving said second end of said first electrical connector, said second electrical connector being releasably attached to said first electrical connector in a pre-lock position, said first and second electrical connectors being movable toward one another from said pre-lock position to a locked position to establish electrical connection between said first and second electrical connectors.

4. An electrical connecting system for extending between a vehicle door and a vehicle body comprising:

a first electrical connector including a first end being adapted for electrical connection to a wiring harness, a second end opposite said first end and an outer periphery extending between said first and second ends;

a second electrical connector for removably receiving said second end of first electrical connector, said first and second electrical connectors being releasably attached in a pre-lock position; and a fastener means attached to said first electrical connector and engaging said second electrical connector in said pre-lock position whereby actuation of said fastener draws said first and second electrical connectors together from said pre-lock position to a locked position to establish electrical connection between said first and second electrical connectors.

5. The electrical connecting system according to claim 4 including a grommet made from a flexible material and receiving said first end of said first electrical connector; said grommet having one end sealing against said first electrical connector and another end adapted for sealingly engaging a surface of a vehicle, and a wire dress cover disposed in and attached to said grommet, said wire dress cover having a leg releasably attached to said first electrical connector whereby when said leg of said wire dress cover is flexed, said wire dress cover becomes detached from said first electrical connector and said wire dress cover and said grommet can be separated from said first electrical connector as an assembly to expose said first end of said first electrical connector.

* * * * *